US007043863B2

(12) United States Patent
Saur

(10) Patent No.: US 7,043,863 B2
(45) Date of Patent: May 16, 2006

(54) MULTI-POSITION SPENT CARTRIDGE CASING CATCHER

(76) Inventor: Thomas W. Saur, 1932 Chestnut, Dearborn, MI (US) 48124-4312

( * ) Notice: Subject to any disclaimer, the term of this patent is extended or adjusted under 35 U.S.C. 154(b) by 94 days.

(21) Appl. No.: 10/946,248

(22) Filed: Sep. 21, 2004

(65) Prior Publication Data

US 2005/0188599 A1 Sep. 1, 2005

Related U.S. Application Data

(63) Continuation-in-part of application No. 10/674,599, filed on Oct. 1, 2003, now Pat. No. 6,836,991.

(51) Int. Cl.
*F41A 15/00* (2006.01)

(52) U.S. Cl. ..... 42/98; 89/33.4; 42/90; 42/106; 206/3; 206/317; 224/0.5

(58) Field of Classification Search ..... 42/98, 42/90, 106; 89/33.4; 206/3, 317, 818; 224/183, 224/0.5

See application file for complete search history.

(56) References Cited

U.S. PATENT DOCUMENTS

| | | | | |
|---|---|---|---|---|
| 1,018,720 | A | 2/1912 | Maxim | |
| 1,027,509 | A | 5/1912 | Smiley | |
| 1,201,189 | A | 10/1916 | Johnson | |
| 1,229,675 | A | 6/1917 | Thompson | |
| 2,706,574 | A * | 4/1955 | Clement | 220/4.22 |
| 2,866,289 | A | 12/1958 | Wilcox | |
| 3,153,981 | A | 10/1964 | Brass | |
| 3,156,991 | A | 11/1964 | Adams | |
| 3,609,900 | A | 10/1971 | Bernocco | |
| 3,618,458 | A | 11/1971 | Pruonto et al. | |
| 3,739,685 | A | 6/1973 | Lundgren | |
| 3,978,602 | A * | 9/1976 | Morrow et al. | 42/98 |
| 4,020,738 | A | 5/1977 | Martinez | |
| 4,028,834 | A * | 6/1977 | Dobson | 42/98 |
| 4,166,333 | A | 9/1979 | Kratzer | |
| 4,204,353 | A | 5/1980 | Isola | |
| 4,334,375 | A | 6/1982 | Olson | |
| 4,430,820 | A | 2/1984 | Marsh | |
| 4,594,803 | A | 6/1986 | Muncy | |

(Continued)

OTHER PUBLICATIONS

Website: www.bushmaster.com/shopping/accessories/el-ar-oo2.asp (dated May 7, 2003), p. 1 of 1.

(Continued)

*Primary Examiner*—Michael Carone
*Assistant Examiner*—Stewart Knox

(57) ABSTRACT

A catcher in combination with a firearm having an ejection port for receiving and retaining expended magnetically attracted shell casings through the ejection port as the firearm is discharged. The catcher includes a hollow housing having a plurality of rigid walls. One of the walls has an opening in communication with the ejection port when the catcher is mounted to the firearm for receiving the shell casings, and at least one of the other walls includes a plurality of deflectors. Each of the deflectors has a front face that is slanted away from the opening such that the deflectors are capable of deflecting the shell casings away from the opening and a rear face that is perpendicular to the planar surface of the housing or slanted away from the opening. Retainers at the rear face of the deflectors are capable of retaining the shell casings when the catcher is in any position. The retainers include a permanent magnetic material.

20 Claims, 4 Drawing Sheets

U.S. PATENT DOCUMENTS

| | | | | |
|---|---|---|---|---|
| 4,715,141 | A * | 12/1987 | Kohnke | 42/98 |
| 4,903,426 | A | 2/1990 | Bammate | |
| 4,959,918 | A | 10/1990 | Perez | |
| 5,033,356 | A | 7/1991 | Richardson | |
| 5,138,787 | A | 8/1992 | Riddle et al. | |
| 5,285,593 | A | 2/1994 | Bammate | |
| 5,398,439 | A | 3/1995 | Harless | |
| 5,651,208 | A | 7/1997 | Benson | |
| 5,934,002 | A | 8/1999 | Blanchet | |
| 6,173,520 | B1 | 1/2001 | Bucciarelli et al. | |
| 6,470,618 | B1 * | 10/2002 | White | 42/90 |
| 6,487,808 | B1 | 12/2002 | Carey | |
| 6,530,169 | B1 | 3/2003 | Griffin | |
| 6,836,991 | B1 * | 1/2005 | Saur | 42/98 |

OTHER PUBLICATIONS

Website: www.gunblast.com/3Bucc__Brass__Catcher.htm (dated May 7, 2003), pp. 1-4.

Website: http://www.remtek.com/arms/steyr/aug/access/catcher.htm (dated May 7, 2003), pp. 1-2.

* cited by examiner

MULTI-POSITION SPENT CARTRIDGE CASING CATCHER

CROSS-REFERENCE TO RELATED APPLICATIONS

This application is a continuation-in-part of U.S. application Ser. No. 10/674,599, filed Oct. 1, 2003 now U.S. Pat. No. 6,836,991.

BACKGROUND OF THE INVENTION

1. Field of the Invention

The present invention relates to a multi-position spent cartridge casing catcher for a firearm.

2. Background Art

Cartridge casing catchers are mounted adjacent the ejection port of a firearm to catch the spent cartridge casings as the casings are ejected after a round is fired. The spent cartridge casings are generally collected for reloading and to prevent casings from being underfoot which can cause a shooter or observer unstable shooting or movement. The spent cartridge casings may also be collected by a cartridge casing catcher (and container) to reduce the evidence left at the shooting site and to reduce the noise generated during the shooting by eliminating the noise generated when the casing impacts the surface (i.e., floor, roof, etc.) where the shooter (i.e., firearm user) is positioned. An example of a conventional spent shell container is shown in U.S. Pat. No. 4,166,333 to Kratzer (Kratzer '333).

Conventional spent cartridge casing catchers such as shown in the Kratzer '333 patent can have a deficiency in that spent cartridges are ejected with a significant force and tend to bounce inside the collection chamber and in some instances, the spent cartridge can bounce back into the firearm ejection port causing the firearm to jam. Such a jam is highly undesirable when the firearm user is involved in a critical mission situation. In any event, clearing jammed firearms is typically a time consuming, annoying, and potentially hazardous task.

Conventional spent cartridge casing catchers such as shown in the Kratzer '333 patent also have a deficiency in that such spent cartridge casing catchers are only effective when the firearm is operated in a normal (typical) design position (i.e., with the weapon trigger grip in a substantially vertical position). That is, such conventional approaches only catch and hold spent cartridge casings when gravitational forces cause the spent cartridge casings to drop or move to a location in the catcher that is generally away from the firearm ejection port. As such, when the user operates the firearm in an orientation that is not the orientation for which the spent cartridge casing catcher was designed (typically a normal firearm operation position), the spent cartridge casings are typically not properly captured and held and can readily cause the firearm to jam in many orientations of the firearm.

However, the firearm user can not always fire the weapon from a position from which the conventional spent cartridge casing catcher was designed to operate, and firearm jams can result. For example, when the shooter desires to obtain a clear shot at a target, to avoid detection, operate the firearm "out of position," fire the weapon "around the clock" (i.e., through a full circle of rotation, including when the weapon is upside down, for instance when firing during a rolling maneuver), etc.

Conventional spent cartridge casing catchers such as shown in the Kratzer '333 patent may have additional deficiencies in that the spent cartridges tend to rattle in the collection chamber and thus cause additional undesirable noise.

Thus, there exists a need and an opportunity for an improved spent cartridge casing catcher. Such an improved spent cartridge casing catcher may overcome deficiencies of conventional approaches.

SUMMARY OF THE INVENTION

Accordingly, the present invention may provide an improved spent cartridge casing catcher. Such an improved spent cartridge casing catcher may provide reduced or eliminated bouncing of the spent cartridges back into the firearm ejection port and so reduce or eliminate jamming caused by the spent cartridge casings bouncing back, and reduced or eliminated rattle of collected spent cartridge casings when compared to conventional approaches.

According to the present invention, a catcher in combination with a firearm having an ejection port for receiving and retaining expended magnetically attracted shell casings through the ejection port as the firearm is discharged is provided. The catcher comprises a hollow housing having a plurality of rigid walls. One of the walls has an opening in communication with the ejection port when the catcher is mounted to the firearm for receiving the shell casings, and at least one of the other walls comprises a plurality of deflectors. Each of the deflectors has a front face that is slanted away from the opening such that the deflectors are capable of deflecting the shell casings away from the opening and a rear face that is perpendicular to the planar surface of the housing or slanted away from the opening. Retainers at the rear face of the deflectors are capable of retaining the shell casings when the catcher is in any position. The retainers comprise a permanent magnetic material.

Also according to the present invention, a catcher in combination with a firearm having an ejection port for receiving and retaining expended magnetically attracted shell casings through the ejection port as the firearm is discharged in any operating position is provided. The catcher comprises a hollow housing having a plurality of rigid walls, wherein one of the walls has an opening in communication with the ejection port when the catcher is mounted to the firearm for receiving and retaining the shell casings, and at least one of the other walls comprises a plurality of deflectors and the deflectors are capable of deflecting the shell casings into the catcher and each of the deflectors has a front face that is slanted away from the opening such that the shell casings are deflected away from the opening and a rear face that is perpendicular to the planar surface of the housing or slanted away from the opening, and retainers capable of retaining the shell casings at the rear face of the deflectors, wherein the retainers comprise a permanent magnetic material.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
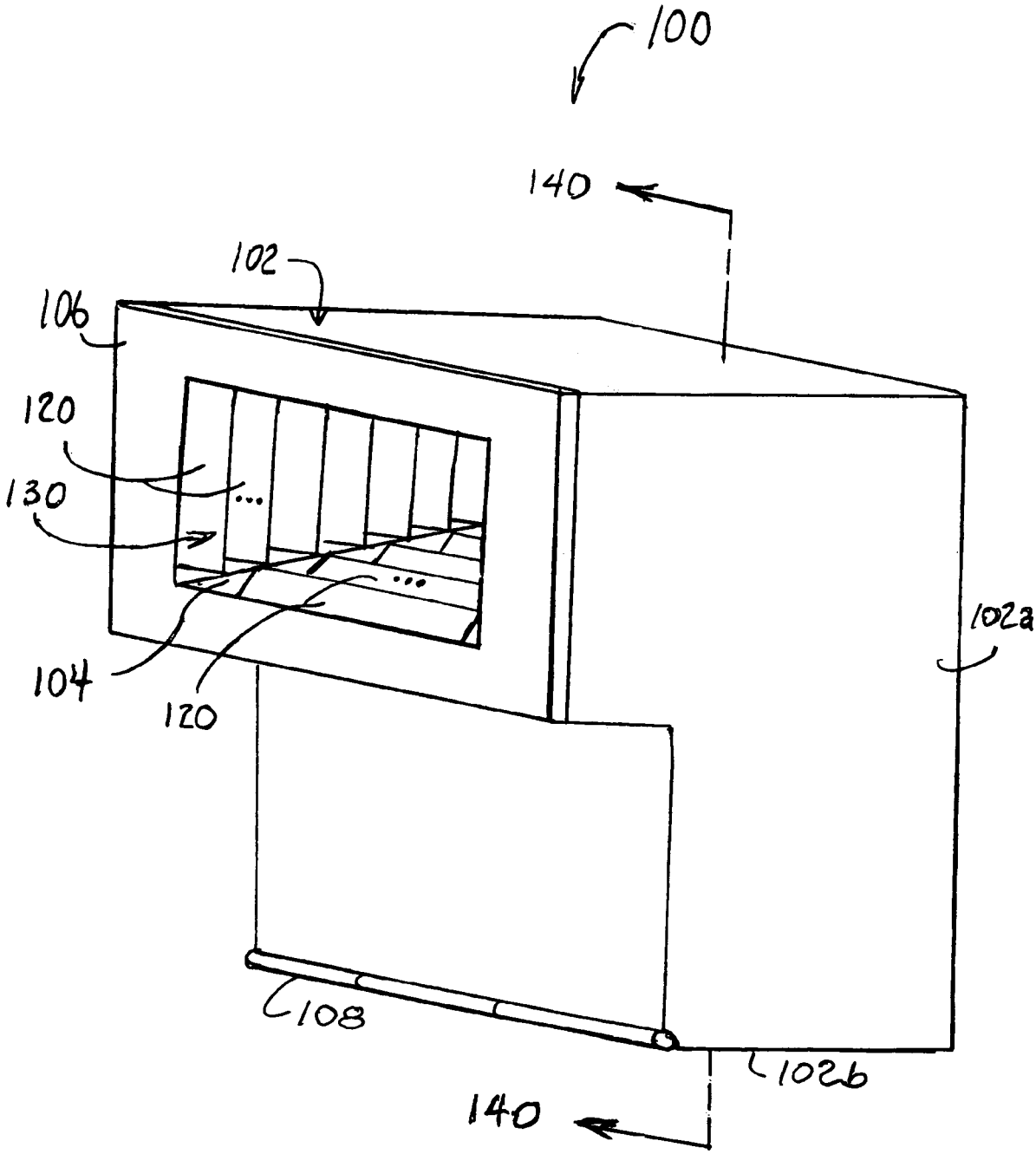
FIG. 1 is a diagram of a perspective view a spent cartridge casing catcher of the present invention.

A user of a firearm (i.e., a shooter) may desire to catch the spent cartridge casings as the casings are ejected from the firearm after a round is fired. The spent cartridge casings(i.e., shell casings) may be collected (e.g., using a cartridge casing catcher (and container)) to prevent the casings from being underfoot which can cause the shooter or an observer unstable shooting or movement. The spent cartridge casings may also be collected by a cartridge casing catcher to reduce the evidence left at the shooting site and to reduce the noise generated during the shooting by eliminating the noise generated when the shell casings impact the surface (i.e., floor, roof, etc.) where the shooter is positioned.

Further, the shooter may wish to reduce or eliminate noise generated by rattle of collected spent cartridge casings in the cartridge casing catcher.

Yet, further, the shooter may wish to operate the firearm in a position other than the normal operating position (i.e., other than with the weapon trigger and grip, and sight alignment in a substantially vertical position) such that the shooter can obtain a clear shot at a target, to avoid detection, etc. by operating the firearm "out of position." Yet further, the shooter may desire to have a cartridge casing catcher that operates properly when the firearm is fired "around the clock" (i.e., in a normal position and through a full circle of rotation generally along any axis of rotation, including when the weapon is upside down, for instance when the shooter is firing the weapon as well as performing a rolling maneuver on a surface, flipping or twisting in mid-air, and the like).

While a number of cartridge casings are produced from non-magnetically attractive materials such as brass and aluminum, cartridge casings are also commonly made of mild steel. The cartridge casings that are made of mild steel are generally attracted (i.e., pulled towards and held) by a magnet. As such, a magnetic material (e.g., a permanent magnet) with sufficient magnetic force will generally be capable of attracting and holding cartridge casings that are particularly made of mild steel (i.e., steel casings), and cartridge casings that are generally made from any ferromagnetic (or other magnetically attracted) material.

With reference to the Figures, the preferred embodiments of the present invention will now be described in detail. Generally, the present invention provides an improved spent cartridge casing catcher. The spent cartridge casing catcher of the present invention is generally mounted (i.e., fastened, fixed, attached, etc.) adjacent to and covering (i.e., over, in communication with, etc.) an ejection port of a semi-automatic or full-automatic firearm. The spent cartridge casing catcher of the present invention is generally used in combination with the firearm.

In one example, the present invention may be advantageously mounted to the firearm via an apparatus similar to the mounting shown in U.S. Pat. No. 4,166,333 to Kratzer (hereinafter Kratzer '333), which is incorporated herein by reference in its entirety. In other examples, the spent cartridge casings catcher of the present invention may be mounted via clamping mechanism apparatuses similar to the mountings shown in U.S. Pat. No. 4,430,820 to Marsh and U.S. Pat. No. 5,651,208 to Benson, which are also incorporated herein by reference in their entirety. However, the cartridge casing catcher of the present invention may be mounted to the firearm where implemented via any appropriate apparatus to meet the design criteria of a particular application.

Referring to FIG. 1, a diagram illustrating a system (i.e., apparatus, assembly, receptacle, etc.) 100 in accordance with the present invention is shown. The apparatus 100 generally comprises a multi-position spent cartridge casing catcher. In one example, the catcher 100 generally comprises a generally hollow housing (i.e., case, box, container, etc.) 102, a liner assembly 104, and a lip area 106. In one example, the housing 102 may be implemented having walls configured as a box-on-box structure or shape (i.e., an upper box and a lower box) as illustrated.

The apparatus 100 is generally implemented (i.e., used) in combination (i.e., in connection) with a firearm. The upper box is generally attached to a firearm (not shown) via an attachment mechanism (not shown) such that an opening 130 into the housing 102 communicates with the ejection port of the firearm and receives spent (or expended) cartridges (i.e., empty shells, casings, brass, etc.) as the shells are ejected from the firearm and the blast that is emitted from the ejection port when the firearm is discharged (i.e., when the firearm is fired). The lower box may comprise fixed walls 102*a*, a lid 102*b* having a hinge 108, and an opposing latch (not shown) that may provide for access to the interior of the shell catcher 100, for example, for emptying spent cartridges from the catcher 100.

The housing 102 may be implemented having a structure similar to the container (10) disclosed in Kratzer '333. However, the housing 102 of the present invention may implemented without a perforated back wall (17) as disclosed in Kratzer '333 since such a perforated wall may provide a path for undesirable noise transmission. Further, the case 102 may be implemented having walls of any appropriate shape and configuration to meet the design criteria of a particular application. The housing 102 is generally produced (i.e., manufactured, built, made, implemented, etc.) using a substantially rigid material. Example materials for implementation of the case 102 may include steel, aluminum, rigid plastic, fiber-reinforced plastic, loaded (e.g., filled with a dense material such as lead, clay, or the like) plastic, and the like.

The liner 104 generally comprises a plurality of deflectors (i.e., fins, blades, wedges, etc.) 120 (described in more detail in connection with FIGS. 2, 3 and 7). In one example, the liner 104 comprises an acoustic foam material that provides barrier and absorption (i.e., the physical process in which incident radiated energy is retained substantially without reflection or transmission) relative to the noise that is presented (i.e., discharged, radiated, emitted, etc.) from the ejection port of the firearm where the catcher 100 is implemented when the firearm is discharged, and damping to the walls of the housing 102.

The liner 104 acoustic foam is generally implemented as a partially-open cell foam having approximately (i.e., about, substantially, essentially, etc.) 85% cell reticulation (i.e., approximately 85% of the cells have walls that are opened via heat or chemical treatment during the production of the foam and approximately 15% of the cells remain closed). The liner 104 acoustic foam is generally implemented as a heat and chemical blast (e.g., firearm report blast) resistant material such as a urethane foam. However, the liner 104 may be implemented form a foam having any appropriate reticulation (e.g., 0% or closed cell foam to essentially 100% or open cell foam) and any appropriate material to meet the design criteria of a particular application. The liner 104 is generally fastened (e.g., fixed, adhered, etc.) to the inside of the container 102 via an appropriate adhesive, rivets, hook and loop, barbs etc. on the inner wall of the housing 102, or any other appropriate fastening or adhering implementation to meet the design criteria of a particular application.

The acoustic foam liner 104 fixed to the inner surface of the case 102 generally forms a combination of acoustic barrier to noise generated by the blast emitted at the ejection port of the firearm when the firearm is discharged (i.e., the walls of the receptacle 100 may have a substantial noise transmission loss for the blast noise), absorption of the noise generated by the blast, and damping of the vibration generated by the impact of a shell casing 150 (shown in FIG. 2) on the housing 102 (i.e., drumming) and deflection of the housing 102 generated by the blast (i.e., so-called "oil-canning"). The fins 120 generally reduce or eliminate tendencies of the casings 150 to move about and rattle in the housing 102 and the liner 104 absorbs noise made by rattling of the casings 150.

The seal 106 generally comprises a resilient, compliant material (e.g., vinyl, butyl, neoprene, etc. in a solid, gel-sac, closed-cell foam, skin covered foam, or other appropriate configuration). The seal 106 is generally fastened to the edge of the housing 102 and liner 104 that abut the ejection port region of the firearm. While the housing 102 and the seal 106 are shown having a substantially flat surface that contacts the firearm where the present invention is implemented, the housing 102 at the opening 130 and the seal 106 are generally shaped to substantially match an interfacing surface of the firearm where the catcher 100 is implemented. When the catcher 100 is mounted to the firearm, the seal 106 generally provides a substantial barrier to noise and flash (e.g., a substantially air-tight or hermetic seal) that is generated during the ejection of a spent cartridge. The seal 106 may be configured to provide a substantially air-tight path between the ejection port and the opening 130.

Figure 2:
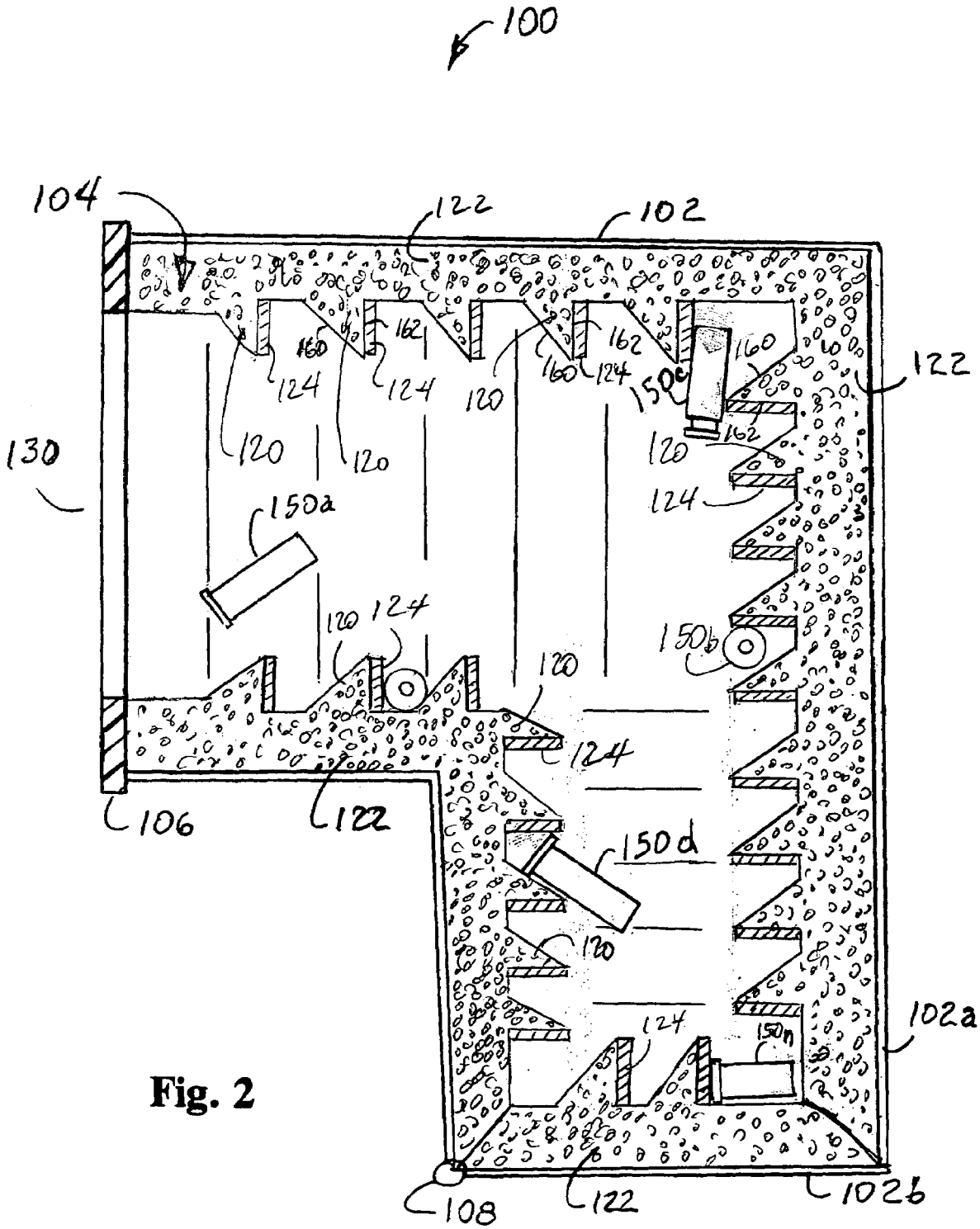
FIG. 2 is a diagram of a sectional view of the catcher of FIG. 1.

Referring to FIG. 2, a diagram illustrating a sectional view of the brass catcher 100 taken at the line 140—140 of FIG. 1 is shown. The liner 104 generally comprises the wedges 120, a base portion (i.e., section, area, layer, etc.) 122, and retainers 124. The wedges (or deflectors) 120 are generally configured to deflect ejected cartridge casings 150 (e.g., casings 150*a*–150*n*) away from the opening 130 (i.e., away from the ejection port of the firearm and towards the lower box region of the housing 102 near the lid 102*b*) as the firearm where the catcher 100 is implemented (or installed) is discharged. The fins 120 generally deflect either rimmed cartridges such as the shell casings 150*a* and 150*d* or rimless casings such as the casing 150*c*.

Each of the wedges 120 may have a face 160 that is oriented toward the opening 130 (also referred to as a front face, hereinafter) and a face 162 that is oriented away from the opening 130 (also referred to as a rear face, hereinafter). The face 160 is generally slanted away from the opening 130 such that the casings 150 are deflected away from the opening 130 and generally toward the lid 102*b*. The face 162 is generally perpendicular the planar surface of the housing 102 or slanted away from the opening 130 such that the casings 150 are resisted from traveling (moving, bouncing, flying, etc.) back toward the opening 130 even when bouncing inside the housing 102. Each of the deflectors 120 generally has the respective front face 160 that is slanted away from the opening 130 such that the deflectors 120 are capable of deflecting the casings 150 away from the opening 130 and the respective rear face 162 that is perpendicular to the planar surface of the housing or slanted away from the opening 130.

The retainers 124 are generally implemented using a permanent magnet material (i.e., a material that is substantially permanently magnetic). The retainers may comprise at least one of steel, a Strontium and Barium ferrite, Samarium-Cobalt, Neodymium-Iron-Boron, other permanently magnetic rare earth alloys, and Alnico (i.e., Aluminum-Nickel-Cobalt alloy). However, the retainers 124 may be implemented using any appropriate permanently magnet material having a magnetic field strength sufficient to hold the expended magnetically attracted (e.g., steel) casings 150 to meet the design criteria of a particular application.

For the permanent magnet retainers 124, the following definitions may be applicable.

Induction, B: The magnetic flux per unit area of a section normal to the direction of flux. The unit of induction is Gauss in the GCS system.

Intrinsic Coercive Force, Hci: An intrinsic ability of a material to resist demagnetization. The Intrinsic Coercive Force value is measured in Oersted and corresponds to zero intrinsic induction in the material after saturation. Permanent magnets with high intrinsic coercive force are referred as "Hard" permanent magnets, which usually associated with high temperature stability.

Hysteresis Loop: A closed curve obtained for a material by plotting corresponding values off magnetic induction, B (on the abscissa), against magnetizing force, H (on the ordinate).

Maximum Energy Product (i.e., maximum magnetic energy product value), $(BH)_{max}$: There is a point at the Hysteresis Loop at which the product of magnetizing force H and induction B reaches a maximum. The maximum value is called the Maximum (Magnetic) Energy Product. At this point, the volume of magnet material required to project a given energy into the respective surrounding is a minimum. The Maximum Energy Product parameter is generally used to describe how "strong" a particular permanent magnet material is. The Maximum Energy Product unit is Gauss Oersted.

The present invention generally implements the retainers 124 having a maximum magnetic energy product value (i.e., level, amount, etc.) that is sufficient to capture and retain (catch and hold), for a particular application, expended shell casings 150 that are magnetically attracted. The deflectors 120 are generally capable of deflecting the cartridge casings 150 away from the opening 130, and the retainers 124 at the rear face of the deflectors 120 are generally capable of retaining the shell casings 150 when the catcher is in (i.e., oriented, held, placed, disposed, etc. in) any position and the firearm where the apparatus 100 is installed is operated in any position.

The retainers 124 may be rectangular shaped. The retainers 124 are generally shaped and sized such that one or more of the retainers 124 are fixed (i.e., fastened, adhered, affixed, etc.) to respective rear faces 162 (i.e., fixed to faces on the sides of deflectors 120 not facing the opening 130) and substantially cover the respective surface 162.

Figure 3:
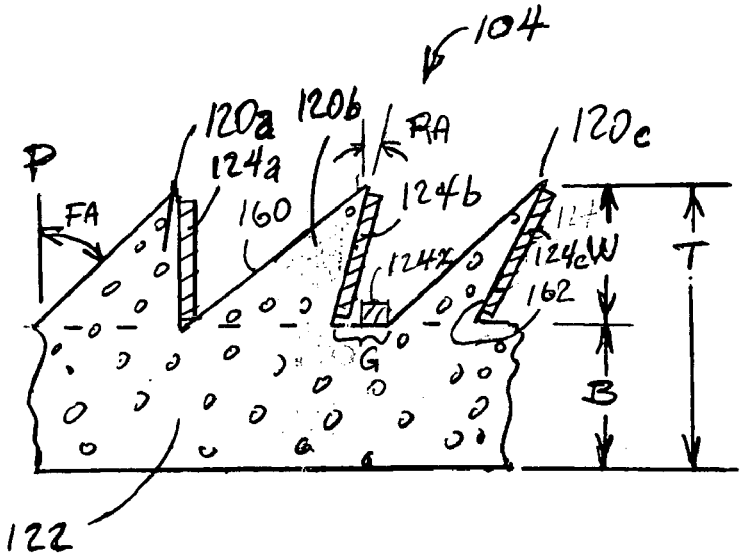
FIG. 3 is a diagram of alternative embodiments of the deflectors and retainers of the present invention.

Referring to FIG. 3, a diagram illustrating a sectional view of alternative embodiments of the deflectors 120 (e.g., deflectors 120*a*–120*c*) is shown. The liner 104 generally has a thickness (e.g., T). The thickness T generally comprises the sum of the thickness of the wedges 120 (e.g., W) and the base portion 122 (e.g., B). That is, T=W+B. The wedges 120 are generally of approximately (i.e., substantially, essentially, about, etc.) the same height (or thickness) W.

The wedge 120 height W is generally equal to or greater than the diameter of the cartridge casing 150 that is captured (or caught) by the brass catcher 100. The base 122 height B is generally approximately equal to the deflector 120 height W. However, the heights W and B may be implemented as any appropriate thickness to meet the design criteria of a particular application.

The front face 160 is generally at an angle (e.g., FA) relative to a line or plane (e.g., P) that is perpendicular to the surface of the region 122 that is fastened to the housing 102. The angle FA is generally in a range of 30 degrees to 75 degrees and preferably in a range of 45 degrees to 60 degrees. The rear face 162 is generally at an angle (e.g., RA) relative to line or plane P. The angle RA is generally in a range of 0 degrees to 35 degrees and preferably in a range of 0 degrees to 25 degrees. The angle RA is generally less than the angle FA. However, the angles FA and RA may be implemented at any appropriate angles to meet the design criteria of a particular application.

In one example, the fins 120 may be adjacent as illustrated by the fins 120*a* and 120*b*. In another example, the fins 120 may be separated by a gap (e.g., G) as illustrated by the fins 120*b* and 120*c*. The gap G is generally approximately equal to or less than the wedge height W. Retainers 124 (e.g., a retainer 124*x*) may be fastened to the foam 122 at the gap G to provide additional retention magnetic material surface.

Implementation of the retainers 124 on the rear faces 162 and the gap G generally provides incoming spent casings 150 an unimpeded path (e.g., the front faces 160). Were retention implemented on all of the inside surface of the wall 102, incoming spent shell casings 150 may impact against casings 150 that have previously been retained and thus be more likely to bounce back into the firearm ejection port and cause jamming of the firearm as well as potentially causing noise from the impact of the shell casings 150 against one another.

Figure 4:
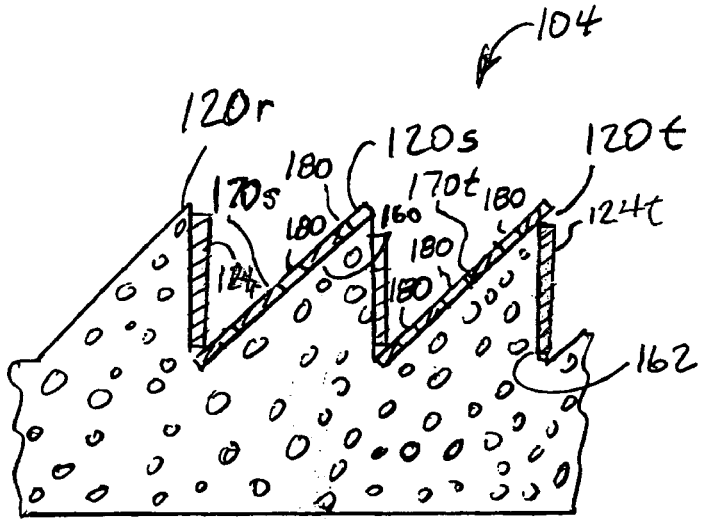
FIG. 4 is a diagram of alternative embodiments of the surfaces of the deflectors of the present invention.

Referring to FIG. 4, a diagram illustrating a sectional view of alternative embodiments of the surface treatment of the deflectors 120 (e.g., deflectors 120*r*–120*t*) is shown. In one example (e.g., wedge 120*r*), the foam that comprises the liner 104 may be uncovered. In another example (e.g., wedge 120*s*), the front surface 160 may be covered by a layer 170. The layer 170 is generally implemented as a perforated material having a plurality of holes 180. The layer 170 is generally implemented from a material such as vinyl, nitrile, butyl, neoprene, and the like. The layer 170 is generally implemented to reduce or eliminate degradation or erosion of the liner 104 due to the blast that is emitted from the ejection port of the firearm during discharge and from the heat of the spent casings 150.

Figure 5:
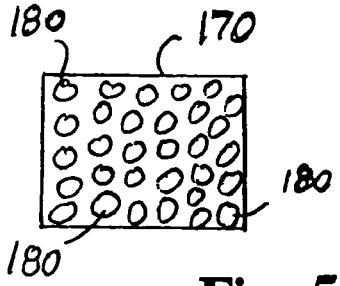
FIG. 5 is a diagram of a planar view of an embodiment of a surface of a facing of a deflector of the present invention.

Referring to FIG. 5, a diagram illustrating a plan view of the layer 170 is shown. The holes 180 generally comprise an area in a range of 30% to 90% of the total area of the layer 170 and preferably an area in a range of 50% to 75% of the total area of the layer 170. The holes 180 area generally sized and of sufficient total area to provide protection of the foam that comprises the liner 104 while providing reduction or elimination of degradation or erosion to the liner 104.

Figure 6:
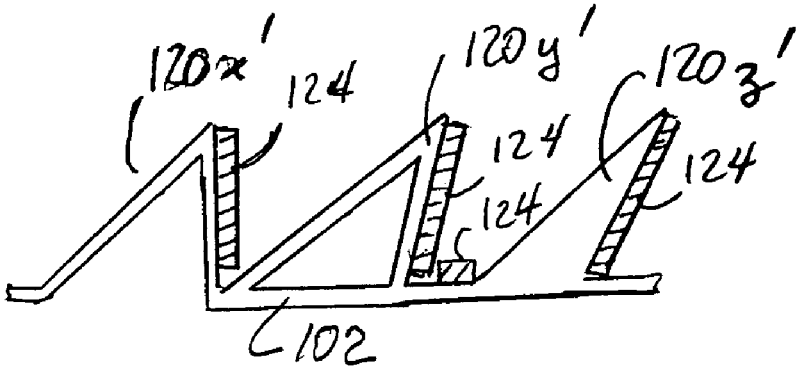
FIG. 6 is another diagram of alternative embodiments of the walls, deflectors and retainers of the present invention.

Referring to FIG. 6, a diagram of an alternative implementation of the wall 102 is shown. In another example, the inner surface of the wall 102 may comprise deflectors 120' (e.g., deflectors 120*x*'–120*z*'). The liner 104 may be deleted and the retainers 124 may be fastened directly to the wall 102. In one example, the wall 102 may have a convoluted shape as shown in connection with wedge 120*x*'. In another example, the wall 102 may have a substantially flat outer surface as shown in connection with the deflector wedge 120*y*' where the wedge is at least partially hollow, and the deflector wedge 120*z*' where the wedge is substantially solid material.

Figure 7:
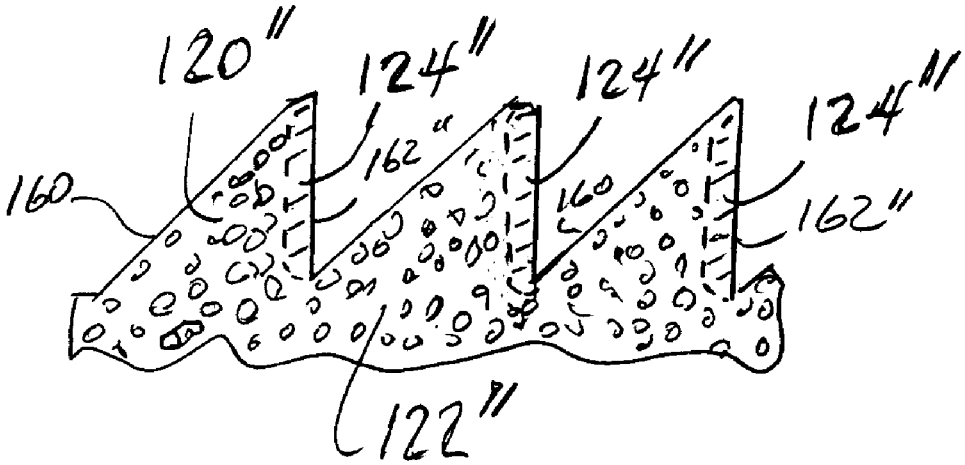
FIG. 7 is yet another diagram of alternative embodiments of the deflectors and retainers of the present invention.

Referring to FIG. 7, a diagram of an alternative implementation of the deflectors 120 (e.g., deflectors 120") is shown. Retainers 124" may be formed (e.g., molded, injected, embedded, melted, integrated into, etc.) within a rear surface 162" of the deflectors 120". While illustrated in connection with foam wedges 120", the retainers 124" may also be implemented in connection with a wall 102 having an inner surface shaped as deflectors 120' as illustrated in FIG. 6.

The user may remove shell casings 150 (e.g., extract, empty, clear, etc.) the catcher 100 by opening the door panel 102*b* or removing the catcher 100 from the firearm to which the catcher 100 is mounted to provide physical access to manually disengage (or separate) the casings 150 from the retainers 124 for removal. In another example, the catcher 100 may be vigorously shaken at a force sufficient to disengage the spent cartridge casings 150 from the retainers 124.

In one example, the system 100 may be advantageously implemented in connection (or in combination) with a firearm having a significant level of noise output from the ejection port (e.g., a firearm that fires from an open bolt). In another example, the system 100 may be advantageously implemented in connection (or in combination) with a firearm having a low level of noise output from the ejection port (e.g., a firearm that fires from a closed or locked breech condition). In yet another example, the system 100 may be advantageously implemented when noise output from the ejection port is not a concern of the user and the user desires to have a cartridge casing catcher that operates in a full range of positions.

As is apparent then from the above detailed description, the present invention may provide an improved multi-position cartridge casing catcher. Such an improved cartridge casing catcher may provide reduced or eliminated noise and flash from a firearm ejection port and so reduce or eliminate jamming caused by the spent cartridges bouncing back, reduced or eliminated rattle of collected shell casings, and reduced or eliminated bouncing of the spent cartridges back into the firearm ejection port as the firearm is operated in any position when compared to conventional approaches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A catcher in combination with a firearm having an ejection port for receiving and retaining expended magnetically attracted shell casings through the ejection port as the firearm is discharged, the catcher comprising:

a hollow housing having a plurality of rigid walls, wherein one of the walls has an opening in communication with the ejection port when the catcher is mounted to the firearm for receiving the shell casings, and at least one of the other walls comprises a plurality of deflectors and each of the deflectors has a front face that is slanted away from the opening such that the deflectors are capable of deflecting the shell casings away from the opening and a rear face that is perpendicular to the planar surface of the housing or slanted away from the opening; and retainers at the rear face of the deflectors capable of retaining the shell casings when the catcher is in any position, wherein the retainers comprise a permanent magnetic material.

2. The catcher of claim 1 wherein the retainers have a maximum magnetic energy product value that is sufficient to capture and retain the expended shell casings.

3. The catcher of claim 1 further comprising a seal attached to the housing at the opening, wherein the seal is configured to provide a substantially air-tight path between the ejection port and the opening.

4. The catcher of claim 3 wherein the seal comprises a resilient, compliant material in a solid, gel-sac, closed-cell foam, or skin covered foam configuration.

5. The catcher of claim 1 wherein deflectors comprise a partially-open cell acoustic foam having approximately 85% cell reticulation.

6. The catcher of claim 1 wherein the magnetic material comprises magnetic strips that are affixed to the rear face of respective deflectors.

7. The catcher of claim 1 wherein each of the deflectors has a height that is equal to or greater than the diameter of the shell casings that are captured by the catcher.

8. The catcher of claim 1 wherein the deflectors are adjacent or separated by a gap.

9. The catcher of claim 8 wherein the magnetic material further comprises magnetic strips that are affixed to the gaps when the deflectors are separated by a gap.

10. The catcher of claim 1 wherein the front surface of each of the deflectors is covered by a layer of a perforated material.

11. The catcher of claim 1 wherein the magnetic material is embedded into the rear face of respective deflectors.

12. The catcher of claim 1 wherein the magnetic material is at least one of steel, Strontium and Barium ferrite, Samarium-Cobalt, Neodymium-Iron-Boron, and Aluminum-Nickel-Cobalt alloy.

13. A catcher in combination with a firearm having an ejection port for receiving and retaining expended magnetically attracted shell casings through the ejection port as the firearm is discharged in any operating position, the catcher comprising:

a hollow housing having a plurality of rigid walls, wherein one of the walls has an opening in communication with the ejection port when the catcher is mounted to the firearm for receiving and retaining the shell casings, and at least one of the other walls comprises a plurality of deflectors and the deflectors are capable of deflecting the shell casings into the catcher and each of the deflectors has a front face that is slanted away from the opening such that the shell casings are deflected away from the opening and a rear face that is perpendicular to the planar surface of the housing or slanted away from the opening; and retainers capable of retaining the shell casings at the rear face of the deflectors, wherein the retainers comprise a permanent magnetic material.

14. The catcher of claim 13 wherein the magnetic material is at least one of steel, Strontium and Barium ferrite, Samarium-Cobalt, Neodymium-Iron-Boron, and Aluminum-Nickel-Cobalt alloy.

15. The catcher of claim 13 wherein the retainers have a maximum magnetic energy product value that is sufficient to capture and retain the expended shell casings.

16. The catcher of claim 13 wherein the magnetic material comprises magnetic strips that are affixed to the rear face of respective deflectors.

17. The catcher of claim 13 wherein each of the deflectors has a height that is equal to or greater than the diameter of the shell casings that are captured by the catcher.

18. The catcher of claim 13 wherein the deflectors are adjacent or separated by a gap.

19. The catcher of claim 18 wherein the magnetic material further comprises magnetic strips that are affixed to the gaps when the deflectors are separated by a gap.

20. The catcher of claim 13 wherein the magnetic material is embedded into the rear face of respective deflectors.

* * * * *